US009534426B2

(12) United States Patent
Akizuki et al.

(10) Patent No.: US 9,534,426 B2
(45) Date of Patent: Jan. 3, 2017

(54) CHILD PROTECTOR MECHANISM

(75) Inventors: Ryujiro Akizuki, Novi, MI (US); Takashi Nishio, Kariya (JP); Nobuko Watanabe, Takahama (JP); Masayuki Tomochika, Anjo (JP); Masanari Iwata, Ichinomiya (JP); Yasuhiko Sono, Hekinan (JP)

(73) Assignee: AISIN SEIKI KABUSHIKI KAISHA, Kariya-Shi, Aichi-Ken (JP)

( * ) Notice: Subject to any disclaimer, the term of this patent is extended or adjusted under 35 U.S.C. 154(b) by 447 days.

(21) Appl. No.: 14/112,704

(22) PCT Filed: Apr. 12, 2012

(86) PCT No.: PCT/JP2012/060023

§ 371 (c)(1),
(2), (4) Date: Oct. 18, 2013

(87) PCT Pub. No.: WO2012/144414

PCT Pub. Date: Oct. 26, 2012

(65) Prior Publication Data

US 2014/0047874 A1 Feb. 20, 2014

(30) Foreign Application Priority Data

Apr. 19, 2011 (JP) ..... 2011-092862

(51) Int. Cl.
*E05C 3/06* (2006.01)
*E05B 77/26* (2014.01)
(Continued)

(52) U.S. Cl.
CPC ..... *E05B 77/265* (2013.01); *E05B 77/26* (2013.01); *E05B 77/22* (2013.01); *E05B 77/24* (2013.01); *Y10T 70/5155* (2015.04)

(58) Field of Classification Search
CPC ..... E05B 77/22; E05B 77/24; E05B 77/26; E05B 77/265
(Continued)

(56) References Cited

U.S. PATENT DOCUMENTS 5,015,020 A * 5/1991 Mizuki ..... E05B 85/243 292/216
5,052,731 A * 10/1991 Hayakawa ..... E05B 77/265 292/336.3
(Continued)

FOREIGN PATENT DOCUMENTS

DE 10258645 A1 * 7/2004 ..... E05B 81/06
EP 1 703 048 A2 9/2006
(Continued)

OTHER PUBLICATIONS

International Search Report (PCT/ISA/210) mailed on May 22, 2012, by the Japanese Patent Office as the International Searching Authority for International Application No. PCT/JP2012/060023.
(Continued)

*Primary Examiner* — Carlos Lugo
(74) *Attorney, Agent, or Firm* — Buchanan Ingersoll & Rooney PC

(57) ABSTRACT

A child protector mechanism includes a base member, a first lever, a second lever, a bush arranged between the first lever and the second lever, a child protector lever for moving the bush to an unset position or a set position, and a position retaining mechanism provided between the first lever and the bush. The bush is retained at each of the unset position and the set position by the position retaining mechanism provided between the first lever and the bush. Therefore, when assembling the bush and the first lever to the base member, the bush is retained at a predetermined position (for example, unset position) with respect to the first lever so that the bush does not move. Thus, the easiness of assembly of
(Continued)

the bush and the first lever and the easiness of assembly of the child protector lever are excellent.

7 Claims, 7 Drawing Sheets

(51) Int. Cl.
*E05C 3/16* (2006.01)
*E05B 77/22* (2014.01)
*E05B 77/24* (2014.01)

(58) Field of Classification Search
USPC ..... 292/216, DIG. 23, DIG. 65
See application file for complete search history.

(56) References Cited

U.S. PATENT DOCUMENTS 5,092,638 A * 3/1992 Mizuki ..... E05B 77/265 292/216
5,308,128 A 5/1994 Portelli et al.
5,520,425 A * 5/1996 Dowling ..... E05B 81/20 292/201
5,762,383 A * 6/1998 Gomi ..... E05B 77/26 292/216
6,382,686 B1 * 5/2002 Ishigaki ..... E05B 77/265 292/201
8,256,805 B2 * 9/2012 Ishiguro ..... E05B 77/26 292/201
2006/0186675 A1 * 8/2006 Suzumura ..... E05B 77/26 292/216
2008/0023971 A1 * 1/2008 Akizuki ..... E05B 77/26 292/201
2011/0254287 A1 10/2011 Akizuki et al.

FOREIGN PATENT DOCUMENTS

FR EP 1004730 A1 * 5/2000 ..... E05B 77/265
FR 2835869 A1 * 8/2003 ..... E05B 77/36
JP 58-78362 U 5/1983
JP 11-022268 A 1/1999
JP 2003-3714 A 1/2003
JP 2006-233456 A 9/2006
JP 4342502 B2 10/2009
JP 2009-257050 A 11/2009
JP 2011-190605 A 9/2011

OTHER PUBLICATIONS

Written Opinion (PCT/ISA/237) mailed on May 22, 2012, by the Japanese Patent Office as the International Searching Authority for International Application No. PCT/JP2012/060023.
European Search Report issued Mar. 14, 2016, by the European Patent Office, in corresponding European Patent Application No. 12774822.6 (7 pages).

* cited by examiner

CHILD PROTECTOR MECHANISM

TECHNICAL FIELD

The present invention relates to a child protector mechanism of a vehicle door lock device, and more specifically, to a protector mechanism capable of preventing a door from opening even when an occupant (child) inside a vehicle cabin attempts to open the door by performing a door opening operation by an inside door handle.

BACKGROUND ART

The child protector mechanism of the vehicle door lock device is disclosed in, for example, Patent Literature 1 below, and includes a base member assembled to a door of a vehicle, a first lever (described as "open lever" in Patent Literature 1) rotatably assembled to the base member and linked with a latch mechanism, a second lever (described as "inside lever" in Patent Literature 1) rotatably assembled to the base member and configured to interlock with an inside door handle, a bush that is arranged between the first lever and the second lever and is retainable at an unset position or a set position, and a child protector lever that is assembled to the base member and is capable of moving the bush to the unset position or the set position. Under a state in which the bush is retained at the unset position by the child protector lever, movement of the second lever is transmittable to the first lever through the intermediation of the bush, and under a state in which the bush is retained at the set position by the child protector lever, the second lever is idly swung with respect to the bush so that the movement of the second lever is untransmittable to the first lever.

CITATION LIST

Patent Literature

[PTL 1] JP 4342502 B

In the above-mentioned child protector mechanism disclosed in Patent Literature 1, the bush is assembled so as to be freely movable by a predetermined amount with respect to the child protector lever. Under a state in which the components including the bush are assembled to the base member, a click member (plate having a node, that is, a crest portion in the middle) provided to the base member and a holding pawl portion provided to the child protector lever elastically engage with each other, to thereby retain the child protector lever at the unset position or the set position with respect to the base member. Note that, the bush and the child protector lever are sub-assembled before being assembled to the base member.

SUMMARY OF INVENTION

Technical Problems

In the above-mentioned child protector mechanism disclosed in Patent Literature 1, when assembling the child protector lever to the base member, the bush freely moves with respect to the child protector lever and is not retained at a predetermined position. Therefore, when assembling the bush and the child protector lever to the base member, the worker needs to assemble the bush and the child protector lever to the base member under a state in which the bush is retained at the predetermined position with respect to the child protector lever. As a result, the easiness of assembly is deteriorated.

Further, the bush for transmitting the movement of the second lever to the first lever is assembled to the child protector lever, and the position of the bush that determines an actuation stroke to be transmitted from the second lever to the first lever is determined via the child protector lever. Therefore, the fluctuation of the position of the bush (that is also the fluctuation of the actuation stroke) is liable to increase, and it is necessary to strictly manage the dimensional accuracy of the first lever and the second lever and the dimensional accuracy of the bush and the child protector lever.

Solution to Problems

The present invention has been made to solve the above-mentioned problems, and therefore there is provided a child protector mechanism, including:

a base member adapted to be assembled to a door of a vehicle;

a first lever rotatably assembled to the base member and adapted to be linked with a latch mechanism;

a second lever rotatably assembled to the base member and adapted to interlock with an inside door handle;

a bush assembled so as to be movable with respect to the first lever and arranged between the first lever and the second lever, the bush being retainable at an unset position or a set position;

a child protector lever that is assembled to the base member and is capable of moving the bush to the unset position or the set position; and a position retaining means (a position retaining mechanism) that is provided between the first lever and the bush and is capable of retaining the bush at each of the unset position and the set position with respect to the first lever.

Under a state in which the bush is retained at the unset position, movement of the second lever is transmittable to the first lever through intermediation of the bush.

Under a state in which the bush is retained at the set position, the second lever is idly swung with respect to the bush so that the movement of the second lever is untransmittable to the first lever.

In this case, the bush may be assembled so as to be movable with respect to the first lever along a longitudinal direction thereof. In this case, it is desired that the bush be sub-assembled to the first lever through intermediation of the position retaining means, and that an assembly position of the first lever with respect to the base member be defined by: a support pin portion that is provided on the base member and rotatably supports the first lever; an engagement wall that is provided on the base member and engages with the first lever to define an initial position of the first lever; and an open lever that is rotatably assembled to the base member at a position between the latch mechanism and the first lever and engages with the first lever.

Advantageous Effects of Invention

In the child protector mechanism according to the present invention, the bush is assembled so as to be movable with respect to the first lever (for example, movable along the longitudinal direction of the first lever), and is retained at each of the unset position and the set position by the position retaining means that is provided between the first lever and the bush. Therefore, when assembling the bush and the first lever to the base member, the bush is retained by the position retaining means at a predetermined position (for example, unset position) with respect to the first lever so that the bush is less liable to move. Thus, when assembling the bush and the first lever to the base member and subsequently assembling the child protector lever to the bush and the base member, the worker does not need to retain the bush at the predetermined position with respect to the first lever, with the result that the easiness of assembly is excellent.

Further, the bush for transmitting the movement of the second lever to the first lever is assembled to the first lever, and the position of the bush that determines the movement (actuation stroke) to be transmitted from the second lever to the first lever is not affected by the dimensional accuracy of the members other than the first lever and the second lever. Therefore, it is possible to suppress the fluctuation of the position of the bush (that is also the fluctuation of the actuation stroke) to a smaller value without strictly managing the dimensional accuracy of the child protector lever, and thus improve the productivity.

When carrying out the present invention described above, the bush may include: a main body portion movable along one side surface of the first lever; a leg portion extending from one end portion of the main body portion, the leg portion engaging with an elongated groove, which is formed at a distal end portion of the first lever and extends in the longitudinal direction thereof so as to be rotatable and movable in the longitudinal direction of the elongated groove, the leg portion passing through the elongated groove; and an arm portion extending from a middle portion of the main body portion, the arm portion passing through an elongated hole, which is formed at a middle portion of the first lever and extends in the longitudinal direction thereof, the arm portion sandwiching the first lever between the arm portion and the main body portion, the arm portion being configured to restrict rotation of the leg portion with respect to the elongated groove and allow movement of the leg portion in the longitudinal direction with respect to the elongated groove. In this case, the first lever may include a crest portion that bulges from another side surface thereof and is formed along the longitudinal direction thereof, the arm portion of the bush may include a claw portion that is formed at a distal end thereof and elastically engages with the another side surface or the crest portion of the first lever, and the claw portion may be set so as to move in a manner of climbing over the crest portion when the bush moves between the unset position and the set position with respect to the first lever. In this case, when the setting or unsetting operation is performed for the child protector lever, the bush moves between the unset position and the set position with respect to the first lever, and thus a clicking feel (set/unset switching feel) is obtained.

Further, when carrying out the present invention described above, the bush may further include a pin portion that engages with an elongated hole provided in the child protector lever, the elongated hole provided in the child protector lever may include an arc portion and a straight portion, the arc portion may be formed into a shape of an arc having a center located on a rotation center of the first lever under a state in which the child protector lever is retained at the unset position, the straight portion may extend from one end of the arc portion and may be formed into a shape of a straight line extending away from the rotation center of the first lever, under a state in which the child protector lever is retained at the unset position and the bush is also retained at the unset position, the movement of the second lever may be transmitted to the first lever through the intermediation of the bush, and the pin portion of the bush may move along the arc portion of the elongated hole of the child protector lever, and when the child protector lever is moved from the unset position to the set position, the pin portion of the bush may move along the arc portion and the straight portion of the elongated hole of the child protector lever so that the bush moves from the unset position to the set position.

In this case, the child protector lever is operated from the unset position to the set position, and thus, at the straight portion of the elongated hole provided in the child protector lever, the bush can be moved appropriately (with higher actuation efficiency as compared to a case where the straight portion of the elongated hole is not provided and the arc portion is extended in the shape of the arc) from the unset position to the set position. As a result, the child protector lever can be downsized.

Further, when carrying out the present invention described above, the base member may be a housing body of a housing assembled to the door, the first lever may be rotatably fitted onto a support pin portion that is integrally provided on the housing body, and movement of the first lever in an axial direction of the support pin portion may be restricted by a pressing portion that is integrally provided on a housing cover assembled to the housing body. In this case, a rivet pin is not necessary when assembling the first lever to the base member, with the result that the easiness of assembly is improved and the cost can be reduced.

DESCRIPTION OF EMBODIMENT

Figure 1:
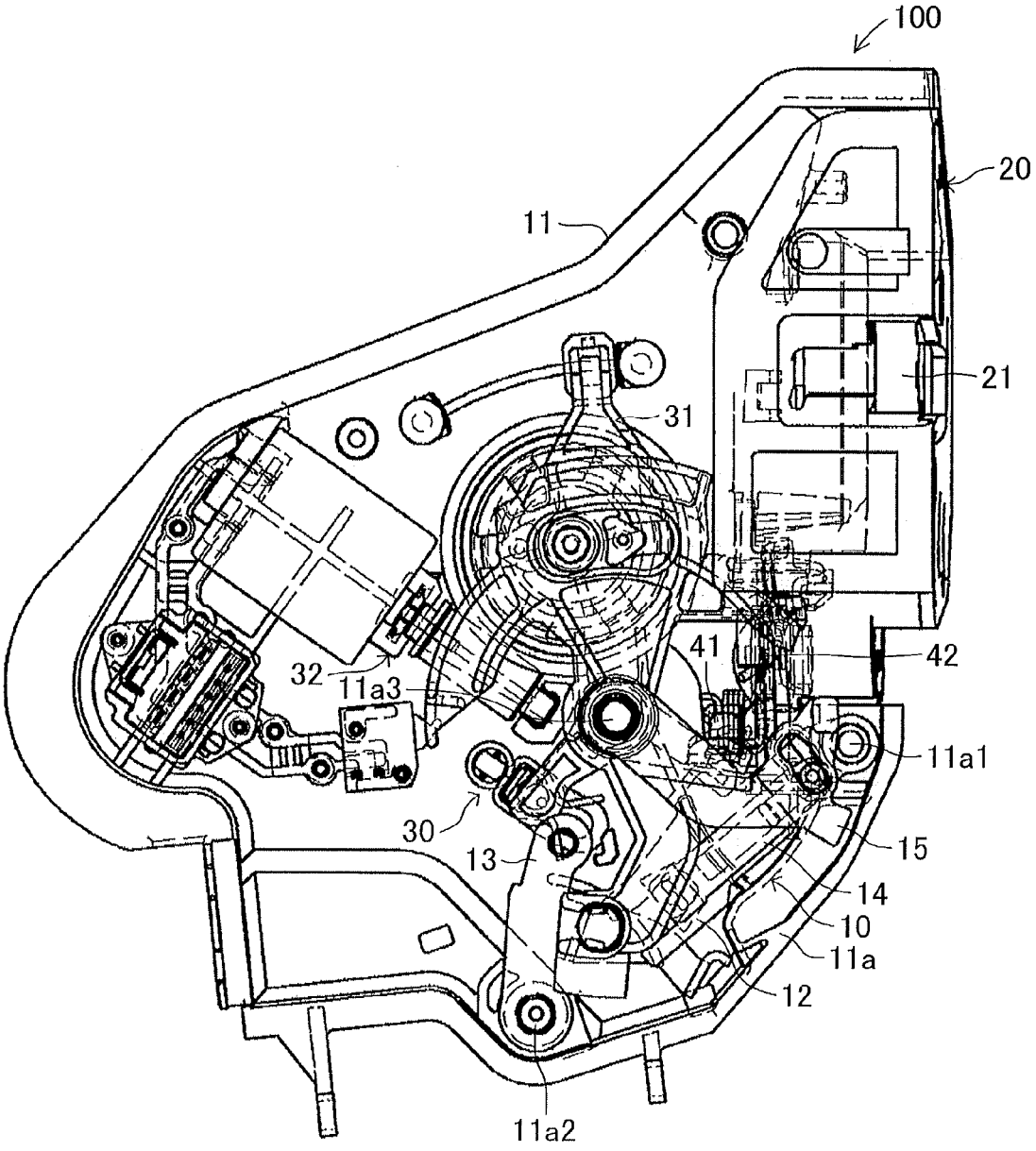
FIG. 1 is a side view illustrating a vehicle door lock device including a child protector mechanism according to an embodiment of the present invention (in a state in which a housing cover is removed from a housing body) as seen from an interior of a vehicle.

Now, an embodiment of the present invention is described with reference to the drawings. FIG. 1 illustrates a vehicle door lock device 100 including a child protector mechanism 10 according to an embodiment of the present invention. The vehicle door lock device 100 is installed in a door (not shown) mounted on a rear right side of a vehicle, and includes, in addition to the child protector mechanism 10, a latch mechanism 20 and a lock mechanism 30. Note that, as is well known, the latch mechanism 20 in a latch state keeps the door closed with respect to a body (vehicle body (not shown)) (keeps a state in which the door is closed), and the latch mechanism 20 in an unlatch state enables the door to be opened with respect to the body. The latch mechanism 20 includes a latch 21 (see FIG. 1) which is engageable with and disengageable from a striker (not shown) fixed to the body. The latch mechanism 20 is assembled to the door under a state in which the latch mechanism 20 is assembled to a housing 11.

Figure 2:
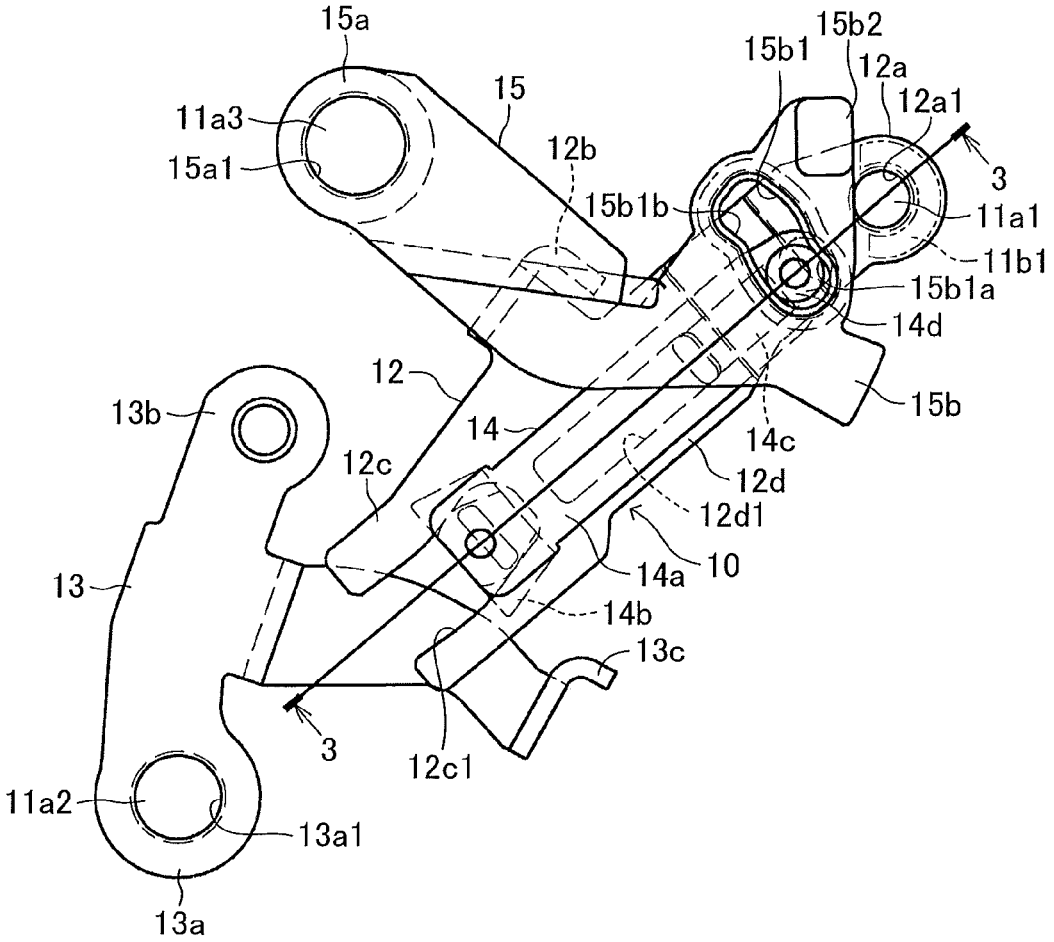
FIG. 2 is an enlarged side view illustrating an unset state of the child protector mechanism of FIG. 1.
Figure 3:
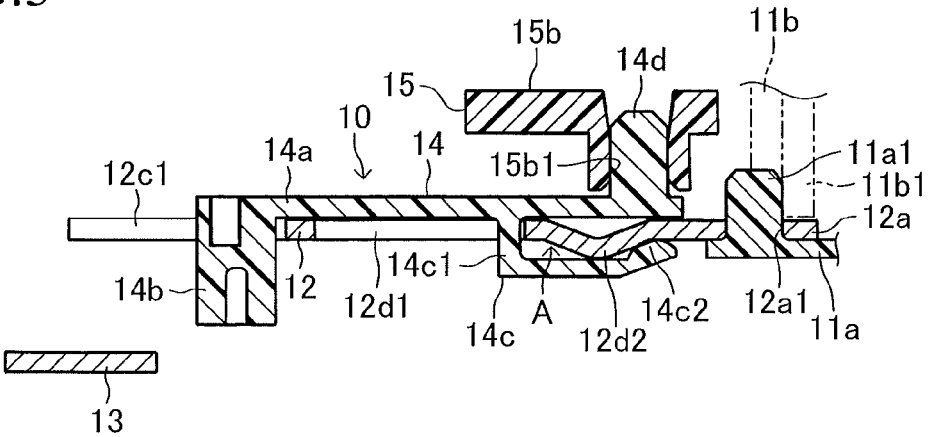
FIG. 3 is a sectional view taken along the line 3-3 of FIG. 2.
Figure 4:
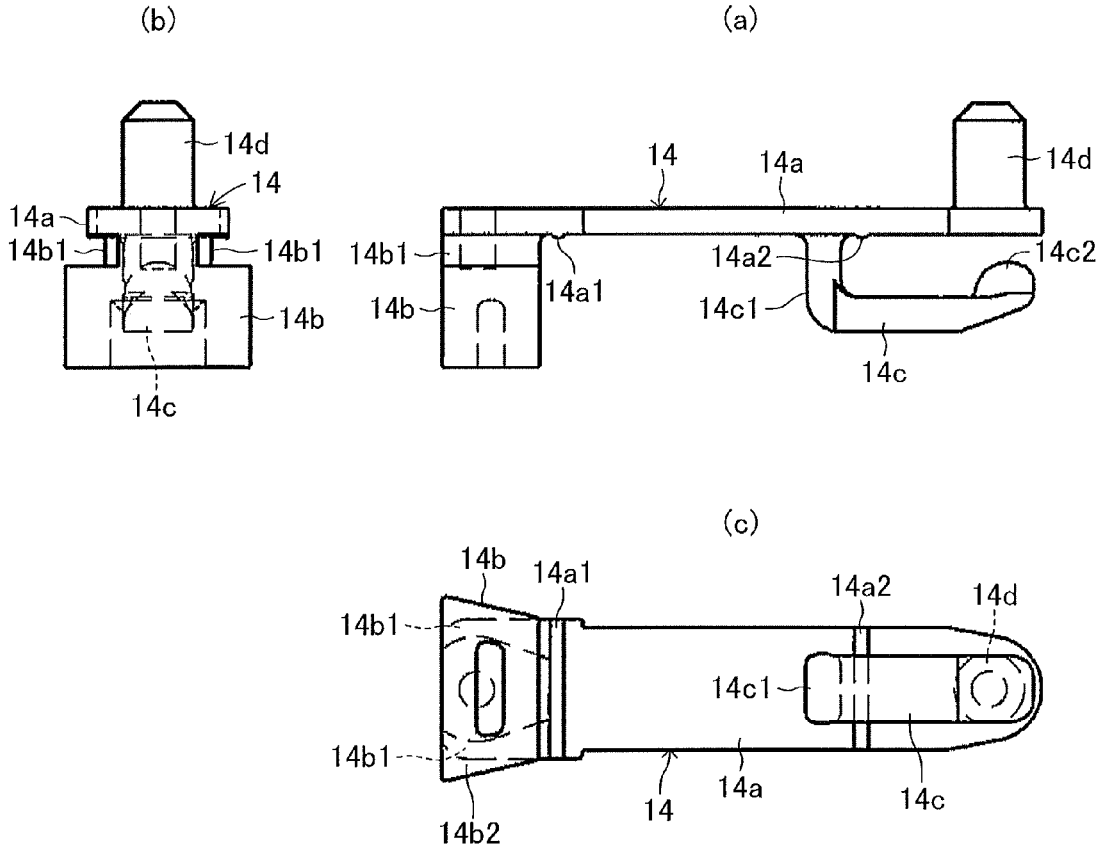
FIG. 4 are three-view drawings (front view, left side view, and bottom view) of a bush of FIGS. 1 to 3.
Figure 5:
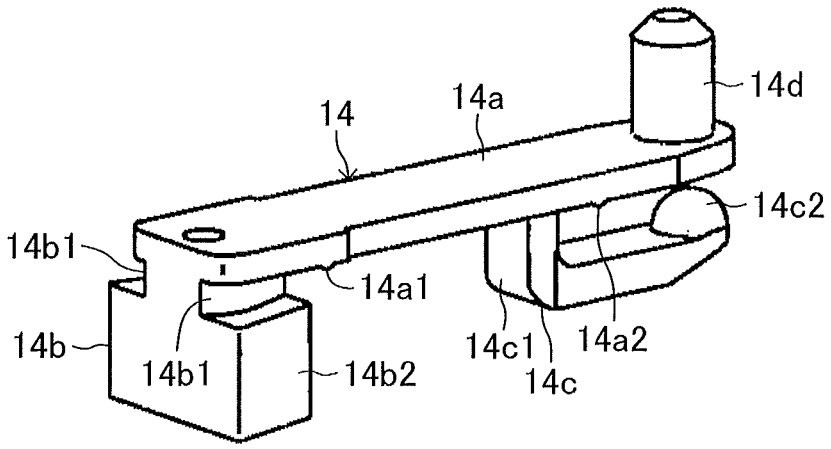
FIG. 5 is a perspective view illustrating the bush of FIG. 4 as seen from an upper side.
Figure 6:
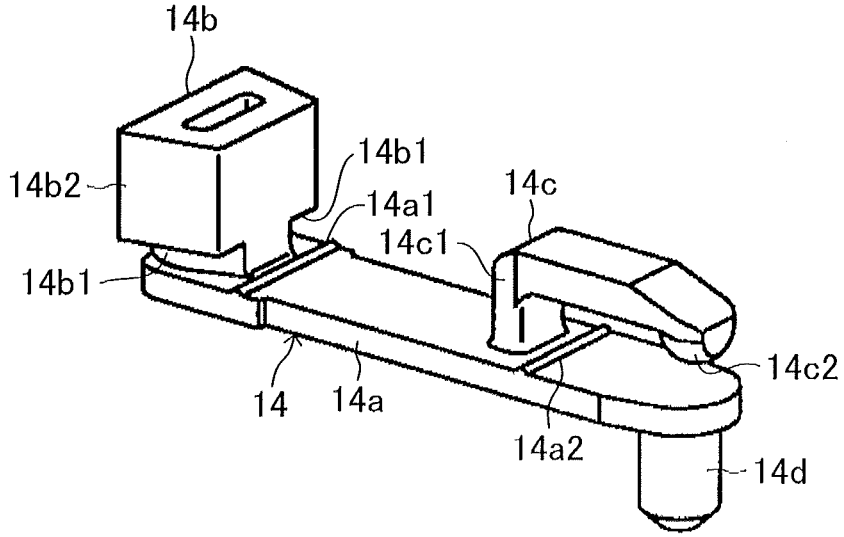
FIG. 6 is a perspective view illustrating the bush of FIG. 5 in an inverted manner.

As illustrated in FIGS. 1 to 3, the child protector mechanism 10 includes: the housing 11 made of a synthetic resin, which is assembled to the door; a first inside open lever (first lever) 12 made of a metal, which is rotatably assembled to the housing 11 and linked with the latch mechanism 20; a second inside open lever (second lever) 13 made of a metal, which is rotatably assembled to the housing 11 and configured to interlock with an inside door handle (not shown); and a bush 14 made of a synthetic resin, which is assembled so as to be movable with respect to the first inside open lever 12 along the longitudinal direction thereof, arranged between the first inside open lever 12 and the second inside open lever 13, and retainable at an unset position or a set position.

Further, the child protector mechanism 10 includes a child protector lever 15 made of a synthetic resin, which is rotatably assembled to the housing 11 and is capable of moving the bush 14 to the unset position or the set position, and also includes a position retaining means (a position retaining mechanism) A (see FIG. 3) that is provided between the first inside open lever 12 and the bush 14 and is capable of retaining the bush 14 at each of the unset position and the set position with respect to the first inside open lever 12.

The housing 11 is formed of a housing body (base member) 11*a* illustrated in FIG. 1 and a housing cover 11*b* (see the imaginary lines in FIG. 3) that is removed from the housing body 11*a* and therefore omitted from FIG. 1. The housing cover 11*b* is formed so as to be assembled to the housing body 11*a*, and the components of the child protector mechanism 10 and the lock mechanism 30 can be accommodated in an accommodating portion formed of the housing body 11*a* and the housing cover 11*b*.

As illustrated in FIGS. 1 to 3, the first inside open lever 12 is rotatably assembled to a support pin portion 11*a*1 formed on the housing body 11*a* through a mounting hole 12*a*1 provided at one end portion (proximal end portion) 12*a* of the first inside open lever 12. Further, the first inside open lever 12 is linked with the latch mechanism 20 at an engagement portion 12*b* formed in a middle portion of the first inside open lever 12 in the longitudinal direction thereof through the intermediation of, for example, an outside open lever 41 (lever interlocking with an outside door handle) and an open link 42 illustrated in FIG. 1. When the lock mechanism 30 is in an unlock state, the first inside open lever 12 is rotated by a predetermined amount in a clockwise direction of FIGS. 1 and 2 so that the latch mechanism 20 in a latch state can be brought into an unlatch state. Note that, when the lock mechanism 30 is in a lock state, even when the first inside open lever 12 is rotated by the predetermined amount in the clockwise direction of FIGS. 1 and 2, the latch mechanism 20 in the latch state is not brought into the unlatch state.

Figure 7:
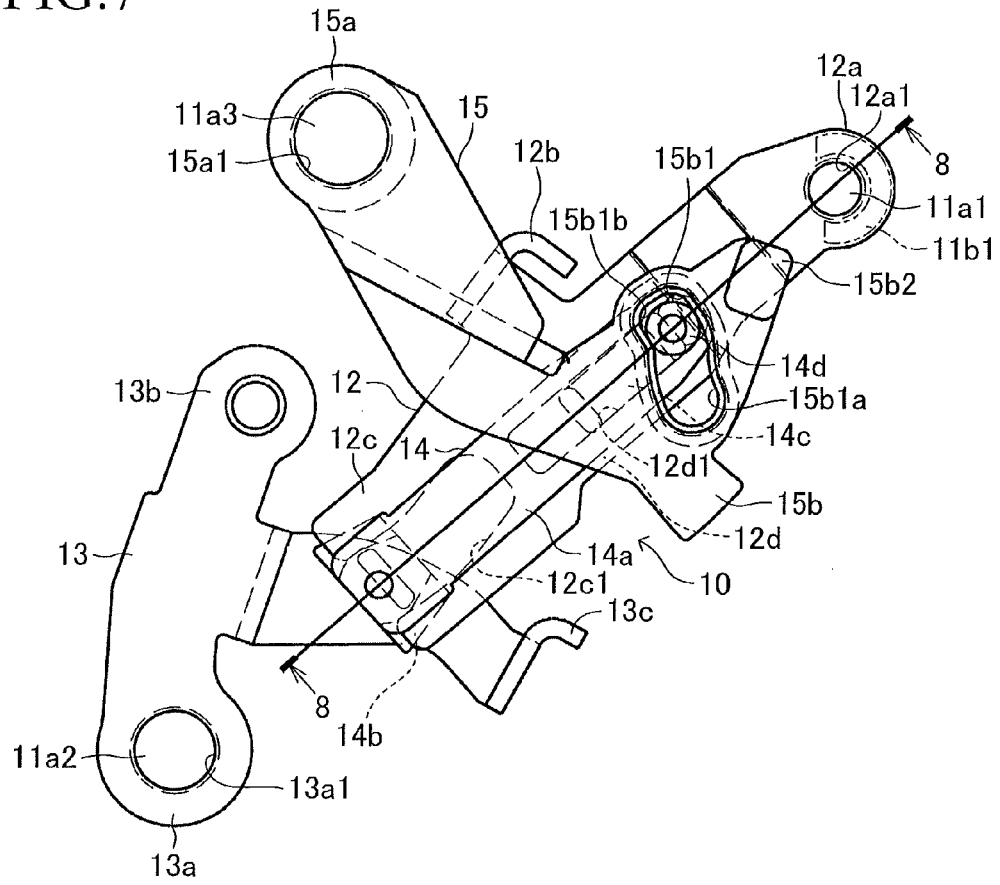
FIG. 7 is a side view illustrating a set state of the child protector mechanism of FIG. 2.
Figure 8:
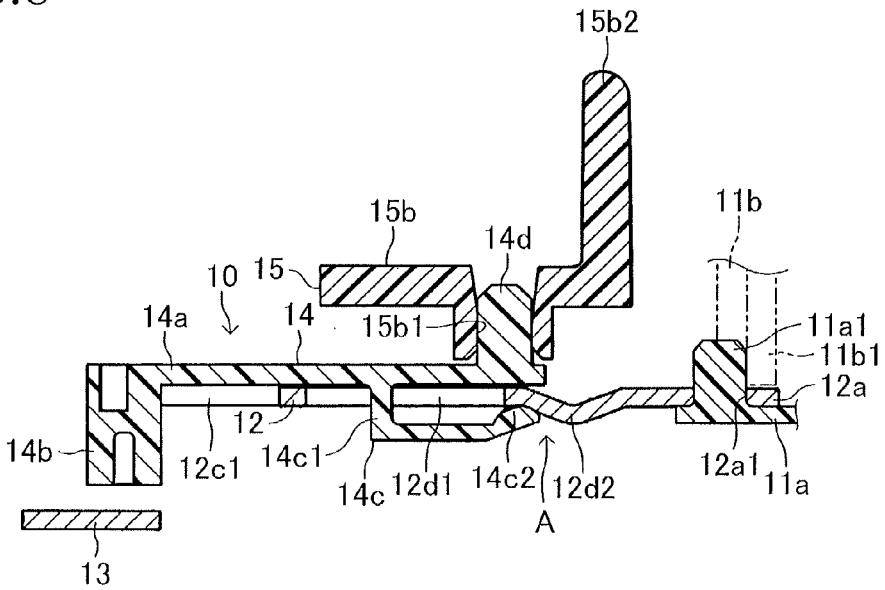
FIG. 8 is a sectional view taken along the line 8-8 of FIG. 7.

As illustrated in FIGS. 1 to 3, the second inside open lever 13 is rotatably assembled to a support pin portion 11*a*2 formed on the housing body 11*a* through a mounting hole 13*a*1 provided at one end portion (proximal end portion) 13*a* of the second inside open lever 13. Further, the second inside open lever 13 is coupled to the inside door handle (not shown) at another end portion (distal end portion) 13*b* through an operation cable (not shown) so as to interlock with the inside door handle. Still further, the second inside open lever 13 is engageable with a leg portion 14*b* of the bush 14, which is retained at the unset position (position in FIG. 2), at an engagement portion 13*c* formed in a middle portion of the second inside open lever 13 in the longitudinal direction thereof. Therefore, when the second inside open lever 13 is rotated by a predetermined amount in a counterclockwise direction of FIGS. 1 and 2 through a door opening operation by the inside door handle, the first inside open lever 12 is rotated by the predetermined amount in the clockwise direction of FIGS. 1 and 2 through the intermediation of the bush 14 retained at the unset position (position in FIG. 2). Note that, when the bush 14 is retained at the set position (position in FIG. 7) at the time of rotation of the second inside open lever 13 through the door opening operation by the inside door handle, the engagement portion 13*c* does not engage with the leg portion 14*b* of the bush 14 but is idly swung with respect to the leg portion 14*b* so that the first inside open lever 12 is not rotated (see FIGS. 10(*c*) and 10(*d*)).

The bush 14 is assembled so as to be movable with respect to the first inside open lever 12 along the longitudinal direction thereof. Further, the bush 14 is arranged between the first inside open lever 12 and the second inside open lever 13, and is retainable at the unset position or the set position. As illustrated in FIGS. 2 to 6, the bush 14 includes a main body portion 14*a*, the leg portion 14*b*, an arm portion 14*c*, and a pin portion 14*d*.

The main body portion 14*a* is formed into a shape extending along the first inside open lever 12 (elongated shape), and is movable (slidable) along one side surface (upper surface in FIG. 3) of the first inside open lever 12. A pair of (two) protrusions 14*a*1 and 14*a*2 for reducing sliding resistance is formed on an engagement surface between the main body portion 14*a* and the first inside open lever 12. The leg portion 14*b* extends from one end portion of the main body portion 14*a* toward the first inside open lever 12. The leg portion 14*b* includes a pair of groove portions 14*b*1 engaging with the first inside open lever 12 so as to be rotatable and movable in the longitudinal direction thereof with respect to an elongated groove 12*c*1, which is formed at a distal end portion 12*c* of the first inside open lever 12 and extends in the longitudinal direction thereof with an open distal end. Further, the leg portion 14*b* includes an engagement portion 14*b*2 having a trapezoidal shape, which is arranged on the second inside open lever 13 side with respect to the above-mentioned elongated groove 12*c*1.

The arm portion 14*c* extends from a middle portion of the main body portion 14*a* in the same direction as that of the leg portion 14*b*. The arm portion 14*c* includes an L-shaped bending portion 14*c*1 passing through an elongated hole 12*d*1, which is formed at a middle portion 12*d* of the first inside open lever 12 and extends in the longitudinal direction thereof. Further, the arm portion 14*c* includes a claw portion 14*c*2, which is formed at a distal end of the bending portion 14*c*1 and sandwiches a crest portion 12*d*2 formed at the middle portion 12*d* of the first inside open lever 12 between the claw portion 14*c*2 and the main body portion 14*a*. With this configuration, the arm portion 14*c* restricts the rotation of the leg portion 14*b* with respect to the elongated groove 12*c*1, and allows the movement of the leg portion 14*b* in the longitudinal direction with respect to the elongated groove 12c1. The pin portion 14d extends from another end portion of the main body portion 14a toward the child protector lever 15, and engages with an elongated hole 15b1 provided in the child protector lever 15.

The child protector lever 15 is rotatably assembled to a support pin portion 11a3 formed on the housing body 11a through a mounting hole 15a1 provided at one end portion (proximal end portion) 15a of the child protector lever 15. The child protector lever 15 includes the above-mentioned elongated hole 15b1 at another end portion (distal end portion) 15b thereof, and also includes a manual operation portion (knob portion) 15b2. With this configuration, the child protector lever 15 is manually rotatable and movable to the unset position (position in FIG. 2) or the set position (position in FIG. 7), and is capable of moving the bush 14 to the unset position or the set position. The manual operation portion (knob portion) 15b2 protrudes outside the housing 11 through an arc-like insertion hole (not shown) provided in the housing cover 11b that is assembled to the housing body 11a, and is manually operable from a vehicle interior side of the door only in a state in which the door is opened. Note that, the arc-like insertion hole (not shown) provided in the housing cover 11b is formed into a shape of an arc having a center located on an axial center of the support pin portion 11a3.

The position retaining means A includes the elongated hole 12d1 and the crest portion 12d2 that are provided at the middle portion 12d of the first inside open lever 12, and the bending portion 14c1 and the claw portion 14c2 that are provided at the arm portion 14c of the bush 14. The crest portion 12d2 bulges from another side surface of the first inside open lever 12, and is formed along the longitudinal direction of the first inside open lever 12. The bending portion 14c1 is configured to abut on one end of the elongated hole 12d1 when the bush 14 is located at the unset position (see FIG. 3). The claw portion 14c2 elastically engages with the another side surface or the crest portion 12d2 of the first inside open lever 12, and is set so as to move in a manner of climbing over the crest portion 12d2 when the bush 14 moves between the unset position and the set position with respect to the first inside open lever 12.

By the way, in this embodiment, before the first inside open lever 12 is assembled to the housing body 11a, the bush 14 is sub-assembled in advance to the first inside open lever 12 through the intermediation of the position retaining means A. Further, assembly positions of the sub-assembled bush 14 and first inside open lever 12 with respect to the housing body 11a are defined, as illustrated in FIG. 9, by the support pin portion 11a1 that is provided on the housing body 11a and rotatably supports the first inside open lever 12, an engagement wall 11a4 that is provided on the housing body 11 and engages with the engagement portion 12b of the first inside open lever 12 to define an initial position of the first inside open lever 12 (position in FIG. 9), and the outside open lever 41 that is rotatably assembled to the housing body 11a at a position between the latch mechanism 20 and the first inside open lever 12 and engages with the first inside open lever 12.

Figure 9:
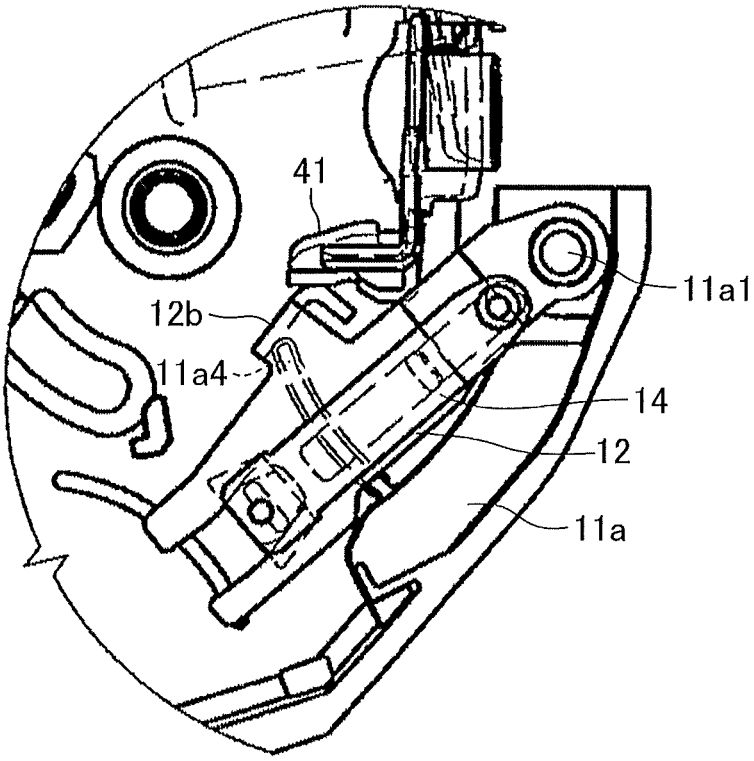
FIG. 9 is a side view illustrating a state in which a first inside open lever and the bush of the child protector mechanism of FIG. 1 are integrally assembled to the housing body.

The outside open lever 41 is biased by a spring (not shown) toward an initial position (position illustrated in FIG. 9). Further, the housing 11 (housing body 11a) is provided with a stopper (not shown) on which the outside open lever 41 is abuttable, and the stopper and the spring described above define the initial position of the outside open lever 41. Therefore, the outside open lever 41 is retained at the initial position when assembling the sub-assembled bush 14 and first inside open lever 12 to the housing body 11a. Thus, the outside open lever 41 can define the assembly positions of the sub-assembled bush 14 and first inside open lever 12.

Further, in this embodiment, the pin portion 14d that engages with the elongated hole 15b1 provided in the child protector lever 15 is provided on the bush 14, and the elongated hole 15b1 provided in the child protector lever 15 includes an arc portion 15b1a and a straight portion 15b1b. The arc portion 15b1a is formed into a shape of an arc having a center located on a rotation center of the first inside open lever 12 (axial center of the support pin portion 11a1) under a state in which the child protector lever 15 is retained at the unset position. The straight portion 15b1b extends from one end of the arc portion 15b1a (upper end in FIG. 2), and is formed into a shape of a straight line extending away from the rotation center of the first inside open lever 12.

Figure 10:
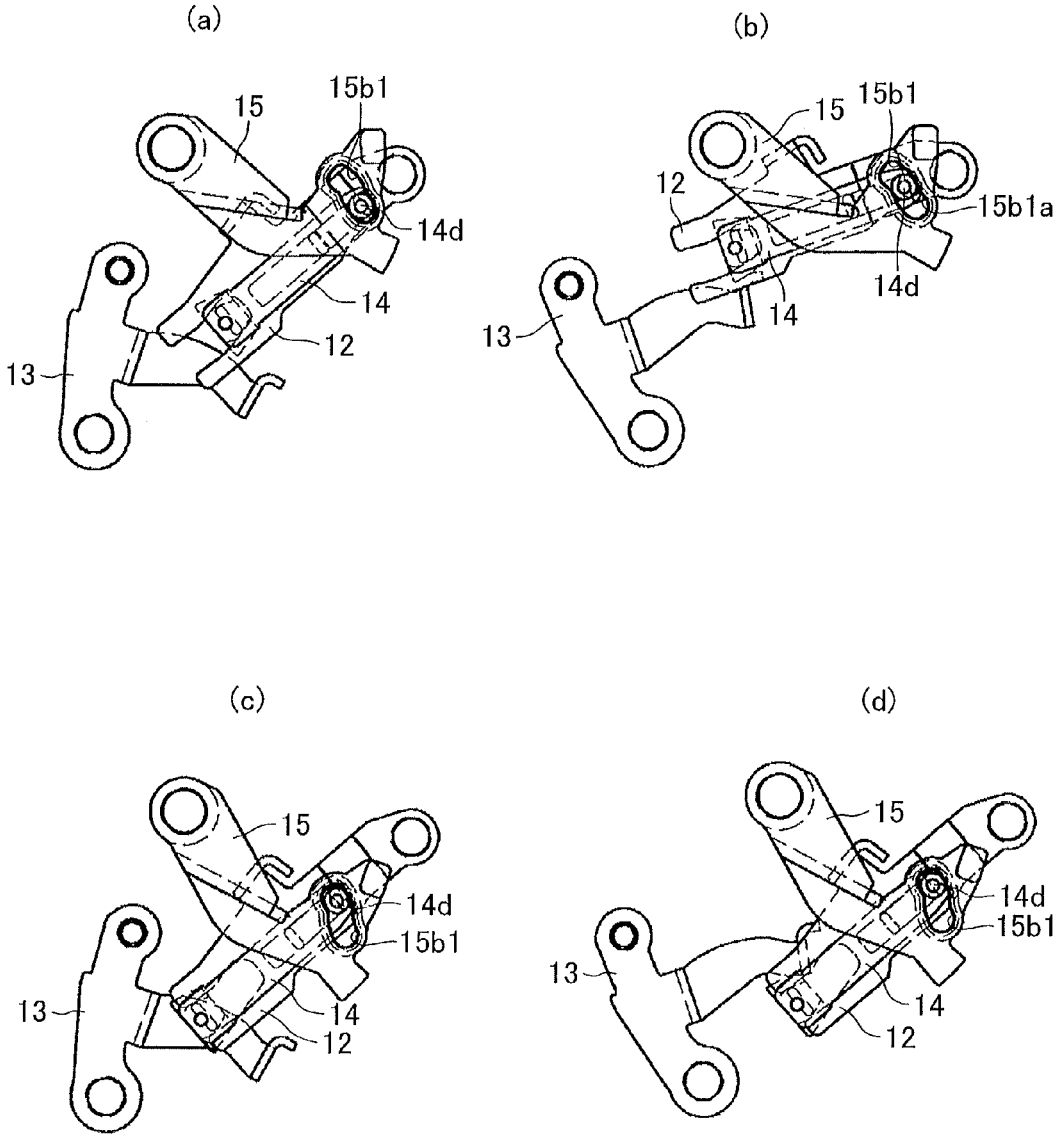
FIGS. 10(*a*)-10(*d*) are explanatory views illustrating actuation of the child protector mechanism of FIGS. 2 and 3.

Further, under a state in which the child protector lever 15 is retained at the unset position and the bush 14 is also retained at the unset position, the movement of the second inside open lever 13 (movement in the counterclockwise direction in FIGS. 2 and 10) is transmitted to the first inside open lever 12 through the intermediation of the bush 14, and along with the movement of the first inside open lever 12 (movement in the clockwise direction in FIGS. 2 and 10), the pin portion 14d of the bush 14 moves along the arc portion 15b1a of the elongated hole 15b1 of the child protector lever 15 (see FIGS. 10(a) and 10(b)).

Further, when the child protector lever 15 is moved from the unset position to the set position, the pin portion 14d of the bush 14 moves along the arc portion 15b1a and the straight portion 15b1b of the elongated hole 15b1 of the child protector lever 15 so that the bush 14 moves from the unset position to the set position with respect to the first inside open lever 12 (see FIGS. 10(a) and 10(c)).

Further, in this embodiment, as illustrated in FIG. 3, the first inside open lever 12 is rotatably fitted onto the support pin portion 11a1 that is integrally provided on the housing body 11a, and the movement of the first inside open lever 12 in the axial direction of the support pin portion 11a1 is restricted by a pressing portion 11b1 (see the imaginary lines in FIG. 2) having a semi-cylindrical shape (partially chipped to prevent interference with the child protector lever 15), which is integrally provided on the housing cover 11b assembled to the housing body 11a. Note that, in this embodiment, also for the rotation support portion (support pin portion 11a2) of the second inside open lever 13 with respect to the housing body 11a and the rotation support portion (support pin portion 11a3) of the child protector lever 15 with respect to the housing body 11a, similarly to the above-mentioned rotation support portion (support pin portion 11a1) of the first inside open lever 12 with respect to the housing body 11a, the movement in the axial direction of each of the support pin portions (11a2 and 11a3) is restricted by a cylindrical pressing portion (not shown) that is integrally provided on the housing cover 11b assembled to the housing body 11a.

As illustrated in FIG. 1, the lock mechanism 30 includes an active lever 31 capable of moving, to an unlock position or a lock position, the open link 42 provided between the child protector mechanism 10 and the latch mechanism 20, and also includes an electric actuator 32 for driving the active lever 31. Note that, detailed configurations of the active lever 31 and the electric actuator 32 are less related to the present invention, and descriptions thereof are therefore omitted herein.

In this embodiment, under a condition that the lock mechanism 30 is in the unlock state (state in FIG. 1), the open link 42 is at the unlock position, and the child protector mechanism 10 is in the unset state (state in FIG. 1), the latch mechanism 20 in the latch state can be brought into the unlatch state through the door opening operation by the inside door handle or the outside door handle. Further, under a condition that the lock mechanism 30 is in the lock state, the open link 42 is at the lock position, and the child protector mechanism 10 is in the unset state, the latch mechanism 20 in the latch state cannot be brought into the unlatch state through the door opening operation by the inside door handle or the outside door handle.

In the child protector mechanism 10 of this embodiment having the configuration as described above, the bush 14 is assembled so as to be movable with respect to the first inside open lever 12 along the longitudinal direction thereof, and is retained at each of the unset position and the set position by the position retaining means A that is provided between the first inside open lever 12 and the bush 14. Therefore, when assembling the bush 14 and the first inside open lever 12 to the housing body 11*a*, the bush 14 is retained by the position retaining means A at a predetermined position (for example, unset position) with respect to the first inside open lever 12 so that the bush 14 is less liable to move. Thus, when assembling the bush 14 and the first inside open lever 12 to the housing body 11*a* and subsequently assembling the child protector lever 15 to the bush 14 and the housing body 11*a*, the worker does not need to retain the bush 14 at the predetermined position with respect to the first inside open lever 12, with the result that the easiness of assembly is excellent.

Further, the bush 14 for transmitting the movement of the second inside open lever 13 to the first inside open lever 12 is assembled to the first inside open lever 12, and the position of the bush 14 that determines the movement (actuation stroke) to be transmitted from the second inside open lever 13 to the first inside open lever 12 is not affected by the dimensional accuracy of the members other than the first inside open lever 12 and the second inside open lever 13. Therefore, it is possible to suppress the fluctuation of the position of the bush 14 (that is also the fluctuation of the actuation stroke) to a smaller value without strictly managing the dimensional accuracy of the child protector lever 15, and thus improve the productivity.

Further, in this embodiment, the bush 14 includes: the main body portion 14*a*; the leg portion 14*b*; and the arm portion 14*c*. Further, the first inside open lever 12 includes the crest portion 12*d*2 that bulges from another side surface thereof and is formed along the longitudinal direction thereof, the arm portion 14*c* of the bush 14 includes the claw portion 14*c*2 that is formed at a distal end thereof and elastically engages with the another side surface or the crest portion 12*d*2 of the first inside open lever 12, and the claw portion 14*c*2 is set so as to move in a manner of climbing over the crest portion 12*d*2 when the bush 14 moves between the unset position and the set position with respect to the first inside open lever 12. Therefore, when the setting or unsetting operation is performed for the child protector lever 15, the bush 14 moves between the unset position and the set position with respect to the first inside open lever 12, and thus a clicking feel (set/unset switching feel) is obtained.

Further, in this embodiment, the elongated hole 15*b*1 of the child protector lever 15 that engages with the pin portion 14*d* of the bush 14 includes the above-mentioned arc portion 15*b*1*a* and straight portion 15*b*1*b*. Under the state in which the child protector lever 15 is retained at the unset position and the bush 14 is also retained at the unset position, the movement of the second inside open lever 13 is transmitted to the first inside open lever 12 through the intermediation of the bush 14, and the pin portion 14*d* of the bush 14 moves along the arc portion 15*b*1*a* of the elongated hole 15*b*1 of the child protector lever 15. When the child protector lever 15 is moved from the unset position to the set position, the pin portion 14*d* of the bush 14 moves along the arc portion 15*b*1*a* and the straight portion 15*b*1*b* of the elongated hole 15*b*1 of the child protector lever 15 so that the bush 14 moves from the unset position to the set position.

Therefore, the child protector lever 15 is operated from the unset position to the set position, and thus, at the straight portion 15*b*1*b* of the elongated hole 15*b*1 provided in the child protector lever 15, the bush 14 can be moved appropriately (with higher actuation efficiency as compared to a case where the straight portion of the elongated hole is not provided and the arc portion is extended in the shape of the arc) from the unset position to the set position. As a result, the child protector lever 15 can be downsized.

Further, in this embodiment, the housing body 11*a* of the housing 11 assembled to the door is the base member, the first inside open lever 12 is rotatably fitted onto the support pin portion 11*a*1 that is integrally provided on the housing body 11*a*, and movement of the first inside open lever 12 in an axial direction of the support pin portion 11*a*1 is restricted by the pressing portion 11*b*1 that is integrally provided on the housing cover 11*b* assembled to the housing body 11*a*. Therefore, a rivet pin is not necessary when assembling the first inside open lever 12 to the housing body 11*a* (base member), with the result that the easiness of assembly is improved and the cost can be reduced.

The invention claimed is:

1. A child protector mechanism, comprising:

a base member configured to be assembled to a door of a vehicle;

a first lever rotatably assembled to the base member and configured to be linked with a latch mechanism;

a second lever rotatably assembled to the base member and configured to interlock with an inside door handle;

a bush assembled so as to be movable with respect to the first lever and arranged between the first lever and the second lever, the bush being retainable at an unset position or a set position;

a child protector lever that is assembled to the base member and is configured to move the bush to the unset position or the set position;

a position retaining mechanism between the first lever and the bush and configured to retain the bush at each of the unset position and the set position with respect to the first lever;

under a state in which the bush is retained at the unset position, movement of the second lever is transmittable to the first lever through intermediation of the bush, under a state in which the bush is retained at the set position, the second lever is idly swung with respect to the bush so that the movement of the second lever is untransmittable to the first lever; and the bush and the first lever together constitute a sub-assembly in which the bush is maintained at a predetermined position by the position retaining mechanism in the sub-assembly during assembly of the bush and the first lever to the base member, preventing movement of the bush, and the sub-assembly being assembled to the base and the child protector lever.

2. A child protector mechanism according to claim 1, wherein the bush is assembled so as to be movable with respect to the first lever along a longitudinal direction of the first lever.

3. A child protector mechanism according to claim 1,
wherein an assembly position of the first lever with respect to the base member is defined by:
a support pin portion that is provided on the base member and rotatably supports the first lever;
an engagement wall that is provided on the base member and engages with the first lever to define an initial position of the first lever; and
an outside open lever that is rotatably assembled to the base member at a position between the latch mechanism and the first lever and engages with the first lever.

4. A child protector mechanism according to claim 1, wherein the bush comprises:
a main body portion movable along one side surface of the first lever;
a leg portion extending from one end portion of the main body portion, the leg portion engaging with an elongated groove, which is formed at a distal end portion of the first lever and extends in a longitudinal direction of the first lever to be rotatable and movable in the longitudinal direction of the elongated groove, the leg portion passing through the elongated groove; and
an arm portion extending from a middle portion of the main body portion, the arm portion passing through an elongated hole, which is formed at a middle portion of the first lever and extends in the longitudinal direction of the first lever, the arm portion sandwiching the first lever between the arm portion and the main body portion, the arm portion being configured to restrict rotation of the leg portion with respect to the elongated groove and allow movement of the leg portion in the longitudinal direction with respect to the elongated groove, and the arm portion being configured to engage the position retaining mechanism.

5. A child protector mechanism according to claim 4,
wherein the first lever comprises a crest portion that bulges from another side surface thereof and is formed along the longitudinal direction thereof,
wherein the arm portion of the bush comprises a claw portion that is formed at a distal end thereof and elastically engages with the another side surface or the crest portion of the first lever, and
wherein the claw portion is set so as to move in a manner of climbing over the crest portion when the bush moves between the unset position and the set position with respect to the first lever.

6. A child protector mechanism according to claim 1,
wherein the bush further comprises a pin portion that engages with an elongated hole provided in the child protector lever,
wherein the elongated hole provided in the child protector lever comprises an arc portion and a straight portion,
wherein the arc portion is formed into a shape of an arc having a center located on a rotation center of the first lever under a state in which the child protector lever is retained at the unset position,
wherein the straight portion extends from one end of the arc portion and is formed into a shape of a straight line extending away from the rotation center of the first lever,
wherein, under a state in which the child protector lever is retained at the unset position and the bush is also retained at the unset position, the movement of the second lever is transmitted to the first lever through the intermediation of the bush, and the pin portion of the bush moves along the arc portion of the elongated hole of the child protector lever, and
wherein, when the child protector lever is moved from the unset position to the set position, the pin portion of the bush moves along the arc portion and the straight portion of the elongated hole of the child protector lever so that the bush moves from the unset position to the set position.

7. A child protector mechanism according to claim 1,
wherein the base member comprises a housing body of a housing assembled to the door,
wherein the first lever is rotatably fitted onto a support pin portion that is integrally provided on the housing body, and
wherein movement of the first lever in an axial direction of the support pin portion is restricted by a pressing portion that is integrally provided on a housing cover assembled to the housing body.

* * * * *